US005683611A

United States Patent [19]

Zauns-Huber et al.

[11] Patent Number: 5,683,611

[45] Date of Patent: Nov. 4, 1997

[54] PREPARATIONS FOR THE OILING OF LEATHER

[75] Inventors: Rudolf Zauns-Huber, Duesseldorf; Fredi Wolter, Moenchengladbach; Guenter Uphues, Monheim; Gilbert Schenker, Erkrath, all of Germany

[73] Assignee: Henkel Kommanditgesellschaft auf Aktien, Duesseldorf, Germany

[21] Appl. No.: 679,475

[22] Filed: Jul. 12, 1996

Related U.S. Application Data

[63] Continuation-in-part of PCT/EP95/00011 Jan. 3, 1995.

[51] Int. Cl.[6] ..... C14C 9/02; C14C 9/04

[52] U.S. Cl. ..... 252/8.57; 8/94.1 R; 8/94.15; 8/94.22; 8/94.23; 427/389

[58] Field of Search ..... 252/8.57; 8/94.1 R, 8/94.15, 94.22, 94.23; 427/389

[56] References Cited

U.S. PATENT DOCUMENTS 5,567,343 10/1996 Ritter ..... 252/8.57

FOREIGN PATENT DOCUMENTS

| | | |
|---|---|---|
| 193832 | 9/1986 | European Pat. Off. . |
| 213480 | 3/1987 | European Pat. Off. . |
| 0265818 | 5/1988 | European Pat. Off. . |
| 372746 | 6/1990 | European Pat. Off. . |
| 412389 | 2/1991 | European Pat. Off. . |
| 0418661 | 3/1991 | European Pat. Off. . |
| 1669347 | 5/1971 | Germany . |
| 3717961 | 5/1988 | Germany . |
| 4129244 | 3/1993 | Germany . |

*Primary Examiner*—Anthony Green

*Attorney, Agent, or Firm*—Ernest G. Szoke; Wayne C. Jaeschke; Daniel S. Ortiz

[57] ABSTRACT

Aqueous dispersions containing special aminopropionic acid derivatives and co-oligomers based on fatty crotonates are suitable for the oiling of leather. The leathers thus treated are distinguished by high resistance to washing and cleaning and by impermeability to water.

22 Claims, No Drawings

PREPARATIONS FOR THE OILING OF LEATHER

This application is a continuation-in-part of PCT application PCT/EP95/00011 filed Jan. 3, 1995.

FIELD OF THE INVENTION

This invention relates to preparations for the oiling of leather. The leathers treated with these preparations are distinguished by high resistance to washing and dry cleaning and by high impermeability to water. The preparations according to the invention are aqueous dispersions containing special aminopropionic acid derivatives and co-oligomers based on fatty crotonates.

RELATED ART

The oiling of vegetable- and/or mineral-tanned leathers and skins is an essential step in the finishing process leading to the ready-to-use material. The form in which the oil is distributed in the skin and the extent to which the oil components are fixed in the skin critically influence the properties and performance of the end products. Extensive expert knowledge exists on possible interactions between the oil components on the one hand and the tanned skin containing residual tanning agents on the other hand. The special composition of the oiling preparations—for example the number of lipophilic groups and reactive groups present, if any, for reaction with suitable reactive constituents in the tanned leather—determined inter alia the permanence and effectiveness of the oil finish in the practical use of the leathers and skins.

An important practical aspect lies in the provision of oil finishes which can be so reliably fixed in the tanned skin that the leathers and skins are sufficiently resistant to washing and cleaning for practical requirements. High-quality leather goods, for example from the clothing industry, are expected to lend themselves both to washing with water/detergents and also to dry cleaning without any significant loss of quality. There are also special cases where the finished leather is required to show sufficient impermeability to water.

In principle, there are in particular three known processes for the waterproof finishing of leather and skins:

1. impregnation by incorporation of water-insoluble compounds, for example solid fats, waxes or special polymers,
2. impregnation by incorporation of water-swelling compounds which form highly viscous emulsions on taking up water and which block the fiber interstices of the leather, for example special emulsifiers of the w/o type,
3. treatment with hydrophobicizing compounds, for example aluminium, chromium and/or zirconium complexes, silicones or organic fluorine compounds.

DE 1 669 347 describes the use of water-emulsifiable sulfosuccinic acid semiesters for oiling leather, although no waterproof effects are obtained.

EP 193 832 relates to a process for the production of waterproof leathers and skins using sulfosuccinic acid monoesters in combination with impregnating and/or hydrophobicizing oiling preparations.

DE 37 17 961 describes a process for the production of N,N-disubstituted β-aminopropionic acids and their use inter alia for hydrophobicizing leather and skins. The compounds in question are produced in two steps by first adding primary alkylamines onto acrylic or methacrylic acid and reacting the N-alkylaminopropionic acids formed with carboxylic anhydrides, carboxylic acid chlorides, sulfonic acid chloride, isocyanates, halocarboxylic acids or acrylic or methacrylic acids. If desired, the products may then be—at least partly—neutralized.

Amphiphilic preparations in the form of selected co-oligomers of, on the one hand, hydrophobic or oleophilic monomers and, on the other hand, hydrophilic monomers have recently been described for the oiling of, in particular, mineral-tanned leathers and skins. Amphiphilic preparations of this type may be incorporated, for example by milling, in the leathers or skins to be finished in the form of aqueous dispersions, emulsions and/or solutions on completion of the main tanning process. In the case of mineral-tanned leathers or skins in particular, the amphiphilic preparations may also perform the retanning function. Finally, the amphiphilic preparations may be fixed, more particularly with mineral tanning agents. The more recent patent literature describes auxiliaries of the type in question.

For example, EP 372 746 describes corresponding preparations and their use, the amphiphilic copolymers consisting predominantly of at least one hydrophobic monomer and, to a lesser extent, of at least one copolymerizable hydrophilic monomer. The hydrophobic monomers listed include long-chain alkyl (meth)acrylates, long-chain alkoxy or alkylphenoxy (polyethylene oxide) (meth)acrylates, primary alkenes, vinyl esters of long-chain alkyl carboxylic acids and mixtures thereof. The hydrophilic comonomers forming the minor component of the copolymers are ethylenically unsaturated water-soluble acids or hydrophilic basic comonomers. The molecular weight (weight average) of the copolymers is in the range from 2,000 to 100,000.

EP 412 389 describes the use of copolymers which have been prepared by radical bulk copolymerization of (a) $C_{8-40}$ monoolefins with (b) ethylenically unsaturated $C_{4-8}$ dicarboxylic anhydrides at temperatures of 80° to 300° C. to form copolymers with molecular weights of 500 to 20,000 g/mole, subsequent solvolysis of the anhydride groups of the copolymers and at least partial neutralization of the carboxyl groups formed during the solvolysis with bases in aqueous medium and which are present in the form of aqueous dispersions or solutions as preparations for hydrophobicizing leather and skins.

EP 418 661 describes the use for the same purpose of copolymers which contain (a) 50 to 90% by weight of $C_{8-40}$ alkyl (meth)acrylates, vinyl esters of $C_{8-40}$ carboxylic acids or mixtures thereof and (b) 10 to 50% by weight of monoethylenically unsaturated $C_{3-12}$ carboxylic acids, monoethylenically unsaturated dicarboxylic anhydrides, semiesters or semiamides of monoethylenically unsaturated $C_{4-12}$ dicarboxylic acids, amides of $C_{3-12}$ monocarboxylic acids or mixtures thereof in copolymerized form and which have molecular weights of 500 to 30,000 g/mole. For the stated application, the copolymers are at least partly neutralized and are present in the form of aqueous solutions or aqueous dispersions.

Studies conducted by applicants have shown that comparatively low molecular weights can be crucially important to the rapid and uniform penetration of oiling compositions of this type. So far as the polymer chemist is concerned, indirect references to this effect can also be found in the last three of the above-cited documents in the description of the production of the copolymers disclosed therein. The radical copolymerization of the claimed components for (a) and (b) is best carried out in the presence of chain transfer agents, such as mercaptans (EP 372 746 A2, page 6, 20/21) and in the presence of regulators, such as $C_{1-4}$ aldehydes, allyl alcohol, but-1-en-3-ol, formic acid or organic compounds containing SH groups (EP 418 661 A1, column 6, paragraph 2). The use of corresponding regulators for obtaining polymers of sufficiently low molecular weight is also recommended in EP 412 389, see A1, column 4, paragraph 2.

Applicants' earlier patent application DE-A-P 41 29 244.8 relates to the use of aqueous dispersions of co-oligomers from radical-initiated aqueous emulsion copolymerization at mildly acidic to neutral pH values as an amphiphilic preparation for the oiling and water-resistant finishing of leather and skins. The main components of these dispersions are semiesters of maleic acid with oleophilic alcohols and/or lower alkylene oxide adducts thereof and acrylic and/or methacrylic acid; small quantities of other hydrophilic and/or oleophilic co-monomers may also be present in the oligomer molecule.

BRIEF DESCRIPTION OF THE INVENTION

The problem addressed by the present invention was to provide preparations for the application mentioned above, i.e. the oiling of leather.

According to the invention, this problem has been solved by aqueous dispersions containing special aminopropionic acid derivatives and co-oligomers based on fatty crotonates. In the context of the invention, fatty crotonates are esters of crotonic acid (trans-2-butenoic acid) with $C_{10-40}$ fatty alcohols.

The present invention relates to aqueous dispersions containing i) at least one aminopropionic acid derivative corresponding to general formula (I):

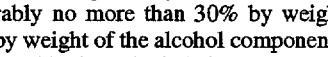

$$R^1-\underset{\underset{Y-R^2}{|}}{N}-CH_2-CHR^3-CO_2X \qquad (I)$$

in which $R^1$ is a saturated or unsaturated, linear or branched alkyl or alkoxyalkyl group containing 8 to 22 carbon atoms, $R^2$ is an alkyl group containing 1 to 18 carbon atoms, a saturated or unsaturated carboxyalkyl group containing 3 to 4 carbon atoms, a carboxyphenyl group or a carboxyl group, $R^3$ is hydrogen or a methyl group, X is hydrogen, alkali metal, alkaline earth metal, ammonium, alkylammonium or alkanolammonium and Y is a group —CO—, —$SO_2$—, —CONH or an alkylene group containing up to three carbon atoms, and ii) at least one water-dispersible and/or water-emulsifiable co-oligomer (II) of a) fatty crotonates and b) radical-copolymerizable hydrophilic ethylenically unsaturated acids and/or anhydrides thereof which may also contain c) small quantities of other copolymerizable monomers.

In one preferred embodiment, the substituent $R^1$ in the formula for the aminopropionic acid derivatives (I) is a saturated alkyl radical predominantly containing 12 to 18 carbon atoms. In another preferred embodiment, the substituent Y in the formula for the aminopropionic acid derivatives (I) is an alkylene group, more particularly a group —$CH_2$—$CH_2$—, and the substituent $R^2$ is a carboxyl group (—$CO_2H$).

Accordingly, the present invention provides a combination of special aminopropionic acid derivatives with co-oligomers based on fatty crotonates, of which the use as an oleophilic main component in amphiphilic preparations of the type in question has not hitherto been described in the prior art, for the oiling of leathers and skins.

The preparations according to the invention are particularly suitable for the rapid and penetrative impregnation of leather and/or skins, so that leathers distinguished by their resistance to washing and cleaning can be obtained. In addition, the leathers obtained show high impermeability to water by virtue of the hydrophobicizing properties of the preparations according to the invention.

DETAILED DESCRIPTION OF THE INVENTION

So far as the co-oligomers (II) are concerned, fatty crotonate components (a) containing $C_{12-24}$ fatty alcohols as their alcohol component are preferred. Linear fatty alcohols or mixtures thereof are preferable in this regard. However, it has been found that, in individual cases, the use of branched fatty alcohols in the fatty crotonate component (a) can also lead to interesting results. For example, the ability of the co-oligomer (II) to penetrate into the fiber structure of the skin to be finished can be enhanced by using branched-chain alcohols to a limited extent. It is also possible in this regard to use corresponding branched alcohols containing a relatively small number of carbon atoms, i.e. corresponding alcohols containing at least 6 carbon atoms and preferably at least 8 carbon atoms. 2-Ethyl-hexanol is an important branched-chain alcohol which may be used in conjunction with the fatty crotonate components (a). However, the quantity of branched-chain and, in particular, relatively short-chain alcohols to be used will always be comparatively limited. Thus, generally no more than 50% by weight and preferably no more than 30% by weight or no more than 20% by weight of the alcohol components present in (a) will be formed by branched-chain, more particularly lower alcohols. For practical purposes, quantities of at least about 90 to 95% by weight—based on the oleophilic fatty crotonate (a)—of the pronounced oleophilic long-chain fatty alcohols, more particularly in the $C_{12-18}$ range, have proved to be particularly suitable components for forming the crotonate esters.

The hydrophilic components (b) used in the amphiphilic co-oligomers (II) may correspond to the corresponding components of the co-oligomers of EP 372 746, 412 389 and 418 661 cited above. The last of these documents in particular contains full details of suitable classes of compounds and mentions many special representatives.

Particularly important components (b) for the co-oligomers (II) in the context of the present invention are ethylenically unsaturated monocarboxylic acids and/or ethylenically unsaturated dicarboxylic acids and/or anhydrides thereof preferably containing up to 12 carbon atoms. The dicarboxylic acids may also be at least partly present in the form of their partial derivatives containing a carboxyl group and a derivatized carboxylic acid group, for example as dicarboxylic acid semiesters.

Particularly interesting representatives from the class of monoethylenically unsaturated $C_{3-12}$ monocarboxylic acids are, for example, acrylic acid, methacrylic acid and crotonic acid. However, dicarboxylic acids and derivatives thereof, particularly anhydrides, may also be particularly suitable components (b). Typical representatives are maleic acid, fumaric acid, itaconic acid, glutaconic acid and corresponding anhydrides.

Maleic anhydride is of particular importance in this regard. Fatty crotonates (a) and maleic anhydride may be satisfactorily reacted in the presence or absence of auxiliary solvents to form co-oligomers (II) of low and readily adjustable molecular weight. More particularly, substantially equal molar quantities of maleic anhydride and fatty crotonate can be reacted with one another so that, after solvolysis, more particularly hydrolysis, of the maleic anhydride units, sufficiently high concentrations of carboxyl groups for fixing the oligomers in the skin or rather fiber structure are available on the one hand while, on the other hand, reliably high contents of the oleophilic and hence oiling and water-repellent fatty crotonate component are also incorporated.

However, in addition to or instead of these hydrophilic components (b) based on carboxylic acids, other copolymerizable hydrophilic compounds may also be used as component (b). Ethylenically unsaturated monomers containing sulfonic acid groups are particularly suitable for this purpose. Known representatives of this type are, in particular, corresponding aliphatic and/or aromatic sulfonic acids, such as styrene sulfonic acid, and also compounds, such as vinylsulfonic acid, allylsulfonic acid, methallylsulfonic acid and the like. As already mentioned, component (b) of the co-oligomer (II) may be formed completely or partly from such copolymerizable or co-oligomerizable sulfonic acid compounds.

Co-oligomers (II) in which components (a) and (b) are present in ratios of 30 to 90% by weight of (a) to 70 to 10% by weight of (b) (percentages by weight, based on the sum of components (a) and (b)) are particularly preferred. Preferred ranges for the mixing ratios are of the order of 35 to 80% by weight of (a) to 65 to 20% by weight of (b).

In addition to components (a) and (b), the amphiphilic co-oligomers (II) may also contain small quantities of other copolymerizable comonomers which are mentioned as component (c) in the above definition. Any co-oligomerizable, ethylenically unsaturated compounds of the type described in the relevant prior art, cf. for example EP 418 661 A1, column 3, 49 to column 4, 27, are suitable for this purpose. The compounds in question are generally comonomers which neither have a pronounced hydrophobicizing effect nor contain hydrophilicizing groups like the carboxyl groups or sulfonic acid groups of components (b) used in accordance with the invention. Where comonomers (c) such as these are used in the amphiphilic co-oligomers according to the invention, their percentage content is preferably no more than about 30% by weight and, in particular, no more than about 15% by weight, based on the sum of (a), (b) and (c).

Particularly preferred co-oligomers (II) for the purposes of the invention are those which are free from the optional components (c) defined above, i.e. are made up solely of components (a) and (b). These preferred co-oligomers (II) contain components (a) and (b) in mixing ratios of around 40 to 70% by weight of (a) to 60 to 30% by weight of (b), based on the sum of (a)+(b).

The co-oligomers (II) based on the fatty crotonates preferably have average molecular weights in the range from about 500 to 30,000 g/mole. Molecular weights in the range from about 1,000 to 15,000 g/mole can be particularly suitable. It has been found that, within these comparatively broad ranges, the lower values—average molecular weights in the range from about 1,000 to 4,000 or 5,000 g/mole and best in the range from about 1,000 to 3,000 g/mole—can be particularly important.

As mentioned above, preferred co-oligomers (II) for the purposes of the invention are those obtainable by reaction of fatty crotonates and maleic anhydride in which the maleic anhydride components have been converted into the corresponding form containing free carboxyl groups by hydrolysis and/or solvolysis with H-active components. However, alcohols in particular and also other compounds, such as carboxylic acids, amino compounds containing reactive hydrogen and the like are also suitable for solvolysis of the maleic anhydride components with H-active components. By controlled solvolysis in this way, it is possible specifically to influence, i.e. enhance, the oiling or water-repellent properties of the co-oligomers (II). In addition, the ratio of oleophilic groups to hydrophilic groups can be displaced towards the water-repellent oleophilic elements by using sufficiently long hydrocarbon chains.

However, the co-oligomers (II) may also be obtained, for example, as follows: in a first process step, the free crotonic acid and maleic anhydride are reacted with one another to form the corresponding oligomer compound. The crotonic acid constituents are then esterified with the desired fatty alcohols or fatty alcohol mixtures in the absence of water with rapid elimination of the water of condensation. This is followed by hydrolysis or solvolysis of the anhydride rings.

The preparations according to the invention are preferably adjusted to a mildly acidic to mildly alkaline pH value. To ensure stability in storage, it can be useful to formulate compositions of which the aqueous phase is adjusted to neutral to mildly alkaline pH values by addition of inorganic and/or organic bases. Any bases described in the relevant prior art may be used for pH adjustment. The alkali metal salts, especially the sodium and/or potassium salts, are particularly preferred. However, ammonium salts or salts of alkanolamines, such as diethanolamine, are also suitable representatives. Preferred pH values for storable products may be in the range from pH 7 to 8. Water-based pastes with a content of components (I) and (II) of, for example, around 30 to around 75% by weight can be prepared in this way. Pastes such as these can always be mixed with water and/or aqueous active-substance mixtures of the type described hereinafter and used in practice.

In one important embodiment, the preparations according to the invention are used together with selected emulsifiers which, on introduction into—in particular—mineral-tanned leathers and/or skins, have an additional oiling or hydrophobicizing effect and which, at the same time, can preferably be fixed in the tanned leather or skin through acidic groups. One important example of compounds of this type are the water-emulsifiable sulfosuccinic acid semiesters mentioned at the beginning which emanate from long-chain fatty alcohols and/or alkylene oxide adducts thereof. One important example of emulsifiers belonging to the class in question are $C_{18}$ sulfosuccinic acid semiesters. It has been found that advantageous effects can be achieved by using emulsifier-like auxiliary components such as these—which are known per se as leather oiling finishes—to assist in solving the problem addressed by the present invention. The following are mentioned as examples of compounds of this type: sulfosuccinic acid semiesters of long-chain fatty alcohols containing in particular 12 to 24 carbon atoms and/or alkylene oxide adducts thereof preferably containing up to 6 alkylene oxide units, corresponding sulfosuccinic acid semiesters of fatty acid mono- and/or diglycerides or alkylene oxide adducts thereof preferably containing up to 6 alkylene oxide groups for a preferred chain length of the fatty acid(s) of $C_{12-24}$ long-chain sulfofatty acids, more particularly corresponding alpha-sulfofatty acids preferably containing 12 to 24 and, more preferably, 16 to 18 carbon atoms (in the case of these alpha-substituted sulfofatty acids, the hydrocarbon radicals are normally saturated) and internal sulfofatty acids of monoolefinically and/or polyolefinically unsaturated carboxylic acids, such as oleic acid, linoleic acid, linolenic acid and the like.

However, the preparations according to the invention may also contain oiling or hydrophobicizing components based on the mixtures known from EP 193 832 cited at the beginning. In this embodiment of the invention, therefore, the mixtures of components (I) and (II) according to the invention—combined with impregnating and/or hydrophobicizing oiling agents, such as sulfosuccinic acid monoester salts with $C_{12-24}$ fatty groups—are used in combination with other impregnating oiling agents selected in particular from the group of oxidized or oxidized and partly sulfonated $C_{18-26}$ hydrocarbons or $C_{32-40}$ waxes. Other examples of these additional impregnating oiling agents are phosphoric acid mono-$C_{12-24}$-alkyl esters, partial esters of polycarboxylic acids, such as citric acid mono-$C_{16-24}$-alkyl esters, partial esters of polyalcohols, such as sorbitan, glycerol or pentaerythritol $C_{16-24}$ fatty acid esters.

One particularly suitable class of emulsifiers which may be used in accordance with the teaching of the invention are the N-acylamino acids known from the oiling of leathers and skins, more particularly the fatty acid sarcosides (for example N-oleoyl sarcosine) which are described in detail in EP-B 0 213 480, for example, as emulsifiers for the introduction of silicone oils into leathers and skins. Accordingly, particularly suitable emulsifiers are salts of N—($C_{9-20}$ acyl)-amino acids, particular significance being attributed to corresponding salts of a $C_{2-6}$ amino acid attached at the amine nitrogen to the acyl group of a saturated or unsaturated $C_{9-20}$ fatty acid which may optionally be additionally substituted by methyl. Particularly suitable salts of these emulsifiers are, again, alkali metal, ammonium or alkanolamine salts.

Of the N—($C_{9-20}$ acyl)-amino acids, those containing 2 to 4 carbon atoms with the amino group in the alpha-position to the carboxyl group, which moreover may additionally be substituted by a methyl group at the amine nitrogen atom, are preferred. Of these, the fatty acid sarcosides of saturated or unsaturated fatty acids containing 9 to 20 and preferably 16 to 18 carbon atoms have a particularly superior effect. The preferred sarcoside is oleic acid sarcoside. In addition, N-stearoyl sarcosine, N-lauroyl sarcosine and N-isononanoyl sarcosine—in the form of their alkali metal salts, ammonium salts or salts of mono-, di- or trialkanolamines, in particular with 2 to 4 carbon atoms in the alkanol group—are particularly suitable.

Where mixtures such as these are used, the quantity of components (I) and (II), which have to be present in accordance with the invention, preferably makes up at least about 35% by weight and, more preferably, at least about 50% by weight of the mixture. In one preferred embodiment, at least about 70 to 80% by weight of the total mixture to be introduced into the leathers or skins to be finished may be based on components (I) and (II).

The preparations according to the invention in the form of an aqueous dispersion or in the form of mixtures with the other components mentioned are introduced in known manner, cf. in particular the disclosures of the above-cited documents for comparable products. Accordingly, their introduction may be briefly summarized as follows:

The dispersions according to the invention are suitable for the treatment of any standard tanned skins, more particularly corresponding material which has been tanned with mineral tanning agents. The tanned skins are normally deacidified before the treatment. They may have been dyed before the treatment. However, dyeing may also be carried out after the treatment according to the invention.

The leather to be impregnated is treated with the dispersions in an aqueous liquor, best at pH values of around 4 to 10 and preferably at pH values of 5 to 8 and at temperatures of around 20° to 60° C. and preferably at temperatures of 30° to 50° C. over a period of up to a few hours and optionally in several stages. The treatment is carried out, for example, by milling in a drum. The quantity of dispersion according to the invention is normally 0.1 to 30% by weight and, more particularly, 1 to 20% by weight, based on the pared weight of the leather or the wet weight of the skins. The length of the liquor is normally 10 to 1,000% and preferably 30 to 150% and, in the case of skins, from 50 to 500%.

On completion of the treatment with the aqueous liquor, the pH of the treatment liquor is shifted to a mildly acidic value by addition of acids. Organic acids, preferably formic acid, are particularly suitable for this purpose. Preferred pH values are in the range from 3 to 5 and more preferably in the range from around 3.5 to 4. If desired, the pH adjustment may be followed by fixing, more particularly with mineral tanning agents, the use of aluminium salts and also other polyvalent mineral salts, for example chromium or zirconium salts, being particularly preferred.

EXAMPLES

1. Preparation of the Compounds to be used in Accordance with the Invention 1.1 Preparation of the Aminopropionic Acid Derivatives (I)

The aminopropionic acid derivatives (I) may be prepared by methods known per se, for example by addition of acrylic or methacrylic acid onto primary alkylamines and subsequent reaction of the N-alkylaminopropionic acids with carboxylic anhydrides, carboxylic acid chlorides, sulfonic acid chlorides, isocyanates, halocarboxylic acids or acrylic or methacrylic acids (cf. for example DE-A-37 17 961 cited above).

1.2 Preparation of the (Amphiphilic) Co-Oligomers (II)

The preparation of the co-oligomers (II) to be used in accordance with the invention is described in the following for four selected examples.

EXAMPLE 1

700 g of a $C_{16/18}$ fatty alcohol crotonate (45–55% $C_{16}$; 45–55% $C_{18}$ fatty alcohols), 300 g of maleic anhydride and 250 g of xylene were weighed into a 3 liter reactor. At a constant bath temperature of 175° C., the reaction mixture was heated to the boiling temperature of the xylene. At an internal temperature of 150° C., 47.5 g of tert.butyl perbenzoate in 47.5 g of xylene were added dropwise over a period of 2 h. Through the onset of polymerization, the internal temperature rose to 164° C. After the initiator had been added, the mixture was left to react for 2 hours at 160° C., after which another 2.5. g of tert.butyl perbenzoate in 2.5 g of xylene were added. After a reaction time of 2 h at 160° C., the xylene was removed in vacuo (50–200 mbar).

After cooling to 80° C., 1,500 g of water and 30.6 g of NaOH were added so that a partly neutralized stable dispersion was formed.

| Residual monomers: | |
|---|---|
| $C_{15}$ crotonate: | 5.1% |
| $C_{18}$ crotonate: | 6.3% |
| Maleic anhydride: | <0.1% |
| **Molecular weights:** | |
| Mw: | 2,100 g/mole |
| Mn: | 1,200 g/mole |
| Solids contents: | 40.2% by weight |

EXAMPLE 2

600 g of a $C_{16/18}$ fatty alcohol crotonate (45–55% $C_{16}$; 45–55% $C_{18}$ fatty alcohols), 400 g of maleic anhydride and 176 g of xylene were weighed into a 3 liter reactor. At a constant bath temperature of 160° C., the reaction mixture was heated to the boiling temperature of the xylene. At an internal temperature of 150° C., 47.5 g of tert.butyl perbenzoate in 117.8 g of xylene were added dropwise over a period of 2 h. Through the onset of polymerization, the internal temperature rose to 169° C. After the initiator had been added, the mixture was left to react for 2 hours at 150° C., after which another 2.5 g of tert.butyl perbenzoate in 6.2 g of xylene were added. After a reaction time of 2 h at 150° C., the xylene was removed in vacuo (50–200 mbar).

After cooling to 80° C., 2,333 g of water and 54.4 g of NaOH were added so that a partly neutralized stable dispersion was formed.

| Residual monomers: | |
|---|---|
| $C_{15}$ crotonate: | 3.9% |
| $C_{18}$ crotonate: | 4.3% |
| Maleic anhydride: | <0.01% |
| **Molecular weights:** | |
| Mw: | 2,000 g/mole |
| Mn: | 1,350 g/mole |
| Solids content: | 30.1% by weight |

EXAMPLE 3

5,600 g of a $C_{16/18}$ fatty alcohol crotonate (45–55% $C_{16}$; 45–55% $C_{18}$ fatty alcohol), 2,400 g of maleic anhydride and 1,800 g of xylene were weighed into a 25 liter reactor. At a constant bath temperature of 170° C., the reaction mixture was heated to the boiling temperature of the xylene. At an internal temperature of 150° C., 400 g of tert.butyl perbenzoate in 600 g of xylene were added dropwise over a period of 2 h. The internal temperature was kept at 150° C. during the reaction. After the initiator had been added, the mixture was left to react for 2 hours at 150° C., after which another 80 g of tert.butyl perbenzoate were added. After a reaction time of 2 h at 150° C., the xylene was removed in vacuo (50–200 mbar).

After cooling to 80° C., 16,000 g of water and 371 g of NaOH were added so that a partly neutralized stable dispersion was formed.

| Residual monomers: | |
|---|---|
| $C_{16}$ crotonate: | 5.6% |
| $C_{18}$ crotonate: | 6.1% |
| Maleic anhydride: | <0.1% |
| **Molecular weights:** | |
| Mw: | 2,100 g/mole |
| Mn: | 1,300 g/mole |
| Solids content: | 34.4% by weight |

EXAMPLE 4

172.2 g of crotonic acid, 206.1 g of maleic anhydride and 100 g of xylene were weighed into a 3 liter reactor. At a constant bath temperature of 175° C., the reaction mixture was heated to the boiling temperature of the xylene. At an internal temperature of 150° C., 18 g of tert.butyl perbenzoate in 64 g of xylene were added dropwise over a period of 2 h. The internal temperature during the polymerization reaction was 150° C. After the initiator had been added, the reaction mixture was left to react for 2 hours at 150° C., after which another 1 g of tert.butyl perbenzoate in 4 g of xylene was added. After a reaction time of 2 h, 515 g of Stenol 1618 (45–55% 45–55% $C_{18}$ fatty alcohol) were added. The polymer was azeotropically esterified with the fatty alcohol over period of 7 h at an internal temperature of 160° C. 34.1 g of water were obtained, corresponding to an esterification conversion of 95%. On completion of esterification, the xylene was removed in vacuo (50–200 mbar).

After cooling to 80° C., 1,340 g of water and 40 g of NaOH were added so that a partly neutralized stable dispersion was formed.

| Residual monomers: | |
|---|---|
| Stenol 1618: | 4.7% |
| Maleic anhydride: | 0.15% |
| Crotonic acid: | 0.05% |
| **Molecular weights:** | |
| Mw: | 10,600 g/mole |
| Mn: | 1,000 g/mole |
| Solids content: | 40.1% by weight |

As used herein, unless otherwise noted, molecular weight refers to number average molecular weight ($M_n$).

We claim:

1. An aqueous dispersion for oiling leather which comprises:

(i) at least one aminopropionic acid derivative of the formula:

$$R^1-\underset{\underset{Y-R^2}{|}}{N}-CH_2-CHR^3-CO_2X \qquad (I)$$

wherein $R^1$ is a saturated or unsaturated, linear or branched alkyl or alkoxyalkyl group containing 8 to 22 carbon atoms, $R^2$ is a group selected from the group consisting of alkyl groups containing 1 to 18 carbon atoms, saturated carboxyalkyl groups containing 3 to 4 carbon atoms unsaturated carboxyalkyl groups containing 3 to 4 carbon atoms, carboxyphenyl groups and carboxyl groups, $R^3$ is hydrogen or a methyl group, X is hydrogen, alkali metal, alkaline earth metal, ammonium, alkylammonium or alkanolammonium and Y is a group selected from the group consisting of —CO—, —$SO_2$—, —CONH and an alkylene group containing up to three carbon atoms;

and (ii) at least one co-oligomer (II) selected from the group consisting of water-dispersible co-oligomers and water-emulsifiable co-oligomers formed from co-monomers comprising (a) fatty crotonates;

(b) at least one member selected from the group consisting of radical-copolymerizable, hydrophilic, ethylenically unsaturated acids and anhydrides thereof;

(c) up to 30% by weight based on a sum of (a)+(b)+(c) of copolymerizable monomers which are not (a) or (b); and (iii) water wherein a weight ratio of (a):(b) is from 30:70 to 90:10 and wherein a sum of the weight of (i) and (ii) in the dispersion is at least 35% by weight of active components in the dispersion.

2. The dispersion as claimed in claim 1 wherein $R^1$ comprises a saturated alkyl group containing 12 to 18 carbon atoms.

3. The dispersion as claimed in claim 1 wherein Y is an alkylene group, and $R^2$ is a carboxyl group.

4. The dispersion as claimed in claim 1 wherein component (a) comprises esters of crotonic acid and $C_{12-24}$ fatty alcohols.

5. The dispersion as claimed in claim 1 wherein the co-oligomer (II), component (b), comprises at least one member selected from the group consisting of ethylenically unsaturated monocarboxylic acids, ethylenically unsaturated dicarboxylic acids, anhydrides of ethylenically unsaturated dicarboxylic acids and ethylenically unsaturated dicarboxylic acid semiesters.

6. The dispersion as claimed in claim 1 wherein component (b) comprises at least one member selected from the group consisting of copolymerizable aliphatic sulfonic acids and aromatic sulfonic acids.

7. The dispersion as claimed in claim 1 wherein co-oligomers (II) are formed from comonomers comprising (c) present at up to 15% by weight (based on the sum of (a), (b) and (c)).

8. The dispersion as claimed in claim 1 wherein the comonomers from which co-oligomers (II) are formed comprise at least one member selected from the group consisting of acrylic acid, methacrylic acid, maleic anhydride, maleic acid, crotonic acid and fumaric acid.

9. The dispersion as claimed in claim 1 wherein the co-oligomers (II) have been produced without use of chain transfer agents or molecular weight regulators.

10. The dispersion as claimed in claim 1 wherein the co-oligomers (II) have a number average molecular weight of 500 to 30,000 g/mole.

11. The dispersion as claimed in claim 1 wherein the co-oligomers (II) are formed from comonomers comprising fatty crotonate and maleic anhydride, and at least a portion of the maleic anhydride comonomer which is polymerized in co-oligomers (II) has been converted into maleic acid or a maleic acid derivative by at least one of hydrolysis or solvolysis with H-active components.

12. The dispersion as claimed in claim 1 wherein the co-oligomers (II) have been produced by co-oligomerization of crotonic acid and maleic anhydride, subsequent esterification of the crotonic acid with fatty alcohols and subsequent opening of the anhydride rings by at least one of hydrolysis or solvolysis.

13. The dispersion as claimed in claim 1 which has been adjusted to a pH value of from 4 to 10.

14. The dispersion as claimed in claim 1 which further comprises emulsifiers which, on introduction into mineral-tanned leathers or skins, have an additional oiling effect and are fixed in the tanned leathers or skins by acidic groups.

15. The dispersion as claimed in claim 1 which additionally contains at least one member selected from the group consisting of emulsifiers and leather oiling components which emulsifiers and oiling components comprise compositions comprising an oleophilic hydrocarbon group and at least one acid group selected from the group consisting of:

sulfosuccinic acid semiesters of $C_{12}$–$C_{24}$ fatty alcohols, sulfosuccinic acid semiesters of alkylene oxide adducts of $C_{12}$–$C_{24}$ fatty alcohols containing up to 6 alkylene oxide units, sulfosuccinic acid semiesters of fatty acid monoglycerides, sulfosuccinic acid esters of fatty acid diglycerides, sulfosuccinic acid semiesters of alkylene oxide adducts of fatty acid monoglycerides containing up to 6 alkylene oxide groups, sulfosuccinic acid esters of alkylene oxide adducts of fatty acid diglycerides containing up to 6 alkylene oxide units, alpha-sulfofatty acids containing 12 to 24 carbon atoms, internal sulfonates of mono-unsaturated fatty acids containing at least 12 carbon atoms, internal sulfonates of polyolefinically unsaturated fatty acids containing at least 12 carbon atoms, salts of amino acids containing 2 to 6 carbon atoms attached at an amine nitrogen atom to an acyl group of a saturated or unsaturated fatty acid containing 9 to 20 carbon atoms, and fatty acid sarcosides.

16. The dispersion as claimed in claim 1 which additionally contains sulfosuccinic acid esters with $C_{12-24}$ fatty groups and at least one composition selected from the group consisting of oxidized $C_{18-26}$ hydrocarbons, oxidized $C_{32-40}$ waxes, oxidized and partly sulfonated $C_{18-26}$ hydrocarbons, oxidized and partly sulfonated $C_{32-40}$ waxes, phosphoric acid mono-$C_{12-24}$-alkyl esters, partial esters of polycarboxylic acids, and partial esters of polyalcohols.

17. The dispersion of claim 1 wherein component (b) comprises at least one member selected from the group consisting of aliphatic sulfonic acids and aromatic sulfonic acids.

18. The dispersion of claim 1 wherein the co-oligomers (II) have a number average molecular weight of from about 1,000 to 15,000 g/mols.

19. The dispersion of claim 1 wherein the co-oligomers (II) have a number average molecular weight of from about 1,000 to 5,000 g/mole.

20. The dispersion of claim 1 wherein the co-oligomers (II) have a number average molecular weight of from about 1,000 to about 3,000 g/mole.

21. A method of finishing tanned leather or skins which comprises introducing the dispersion of claim 1 into the leathers and skins to be finished: and fixing the at least one aminopropionic acid derivative (I) and the co-oligomers (II) in the leathers or skins by an after-treatment with mineral tanning agents.

22. A method for oiling leather which comprises impregnating the leather with an aqueous dispersion comprising:

(i) at least one aminopropionic acid derivative of the formula:

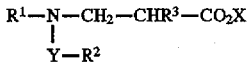

(I)

wherein $R^1$ is a saturated or unsaturated, linear or branched alkyl or alkoxyalkyl group containing 8 to 22 carbon atoms, $R^2$ is a group selected from the group consisting of alkyl groups containing 1 to 18 carbon atoms, saturated carboxyalkyl groups containing 3 to 4 carbon atoms, unsaturated carboxyalkyl groups containing 3 to 4 carbon atoms, carboxyphenyl groups and carboxyl groups, $R^3$ is hydrogen or a methyl group, X is hydrogen, alkali metal, alkaline earth metal, ammonium, alkylammonium or alkanolammonium and Y is a group selected from the group consisting of —CO—, —$SO_2$—, —CONH and alkylene groups containing up to three carbon atoms;

(ii) at least one co-oligomer (II) selected from the group consisting of water-dispersible co-oligomers and water-emulsifiable co-oligomers formed from co-monomers comprising (a) fatty crotonates;

(b) at least one member selected from the group consisting of radical-copolymerizable hydrophilic ethylenically unsaturated acids and anhydrides thereof; and (c) up to 30% by weight based on a sum of (a)+(b)+(c) of copolymerizable monomers, which are not (a) or (b); and (iii) water wherein a weight ratio of (a):(b) is from 30:70 to 90:10 and wherein a sum of the weight of (i) and (ii) in the dispersion is at least 35% by weight of active components in the dispersion.

* * * * *